US005507598A

United States Patent [19]

Huete

[11] Patent Number: 5,507,598

[45] Date of Patent: Apr. 16, 1996

[54] MINIMAL TENSION LEG TRIPOD

[75] Inventor: David A. Huete, Spring, Tex.

[73] Assignee: Shell Oil Company, Houston, Tex.

[21] Appl. No.: 370,765

[22] Filed: Dec. 23, 1994

[51] Int. Cl.[6] ..... E02B 17/00; B63B 35/44

[52] U.S. Cl. ..... 405/223.1; 405/203; 405/224

[58] Field of Search ..... 405/223.1, 195.1, 405/203, 205, 224; 114/264, 265; 175/7

[56] References Cited

U.S. PATENT DOCUMENTS

| | | | |
|---|---|---|---|
| 3,577,946 | 5/1971 | Horton | 114/265 |
| 3,934,528 | 1/1976 | Horton et al. | 114/296 |
| 3,982,492 | 9/1976 | Steddum | 114/265 |
| 4,114,393 | 9/1978 | Engle, Jr. et al. | 114/264 |
| 4,198,179 | 4/1980 | Pease et al. | 405/223.1 X |
| 4,320,993 | 3/1982 | Hunter | 405/224 |
| 4,421,436 | 12/1983 | Burns | 405/60 |
| 4,423,985 | 1/1984 | Aagaard | 405/224 |
| 5,190,411 | 3/1993 | Huete et al. | 405/223.1 |
| 5,199,821 | 4/1993 | Huete et al. | 405/202 |
| 5,423,632 | 6/1995 | Ekvall et al. | 405/223.1 |

*Primary Examiner*—Stephen J. Novosad
*Attorney, Agent, or Firm*—Mark A. Smith

[57] ABSTRACT

A tension leg tripod is disclosed for supporting surface facilities on a deck for conducting hydrocarbon recovery operations in deepwater location applications. The tension leg tripod has an elongated, buoyant central vertical column or caisson with three outrigger pontoons. Three tendons are grouped in tendon cluster arrays, each being connected on one end to the outrigger pontoons at a location which is spaced apart from the vertical. The other end of the tendons are anchored to the ocean floor.

8 Claims, 5 Drawing Sheets

FIG. 1
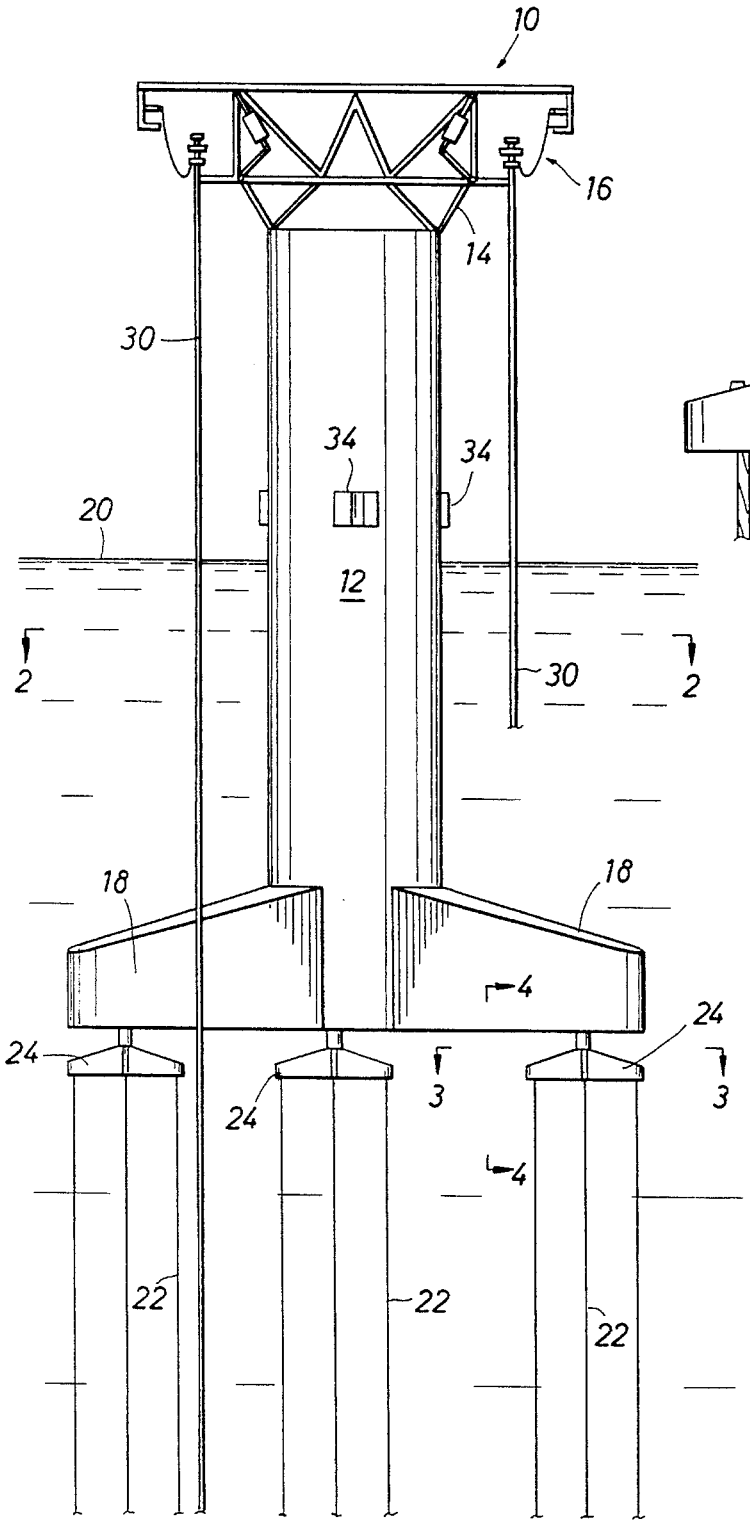
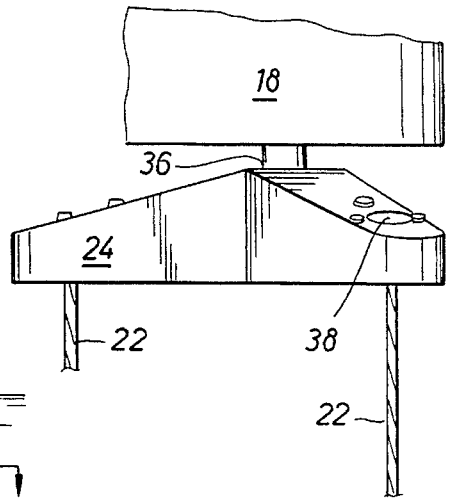
FIG. 4

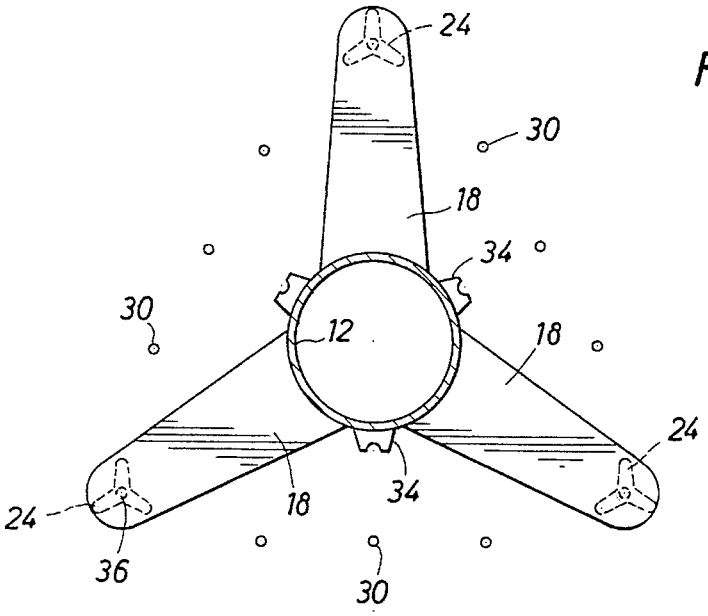
FIG. 2
FIG. 3
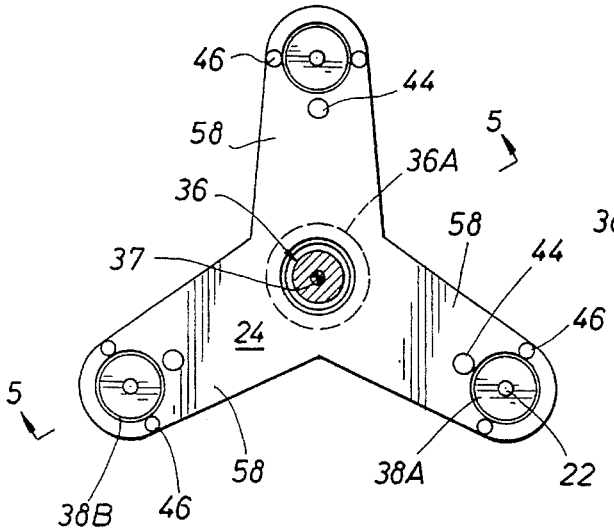
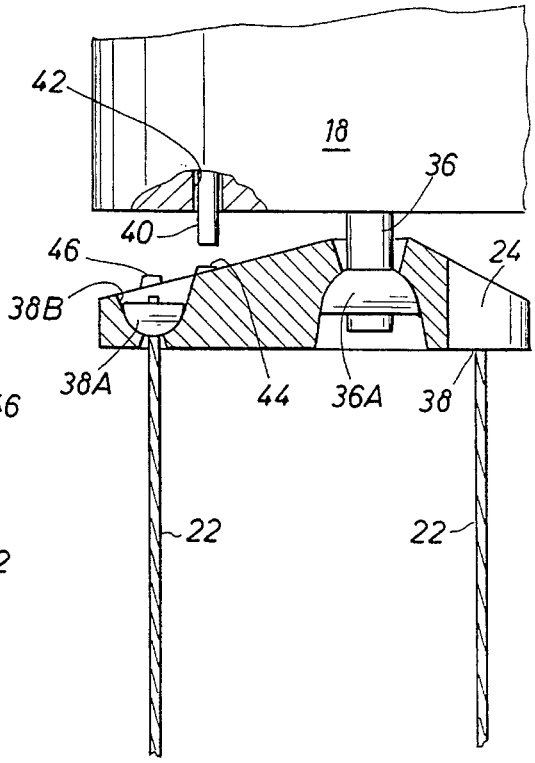
FIG. 5

MINIMAL TENSION LEG TRIPOD

BACKGROUND OF THE INVENTION

The present invention relates to deepwater offshore platforms. More particularly, it relates to single caisson, tethered structures.

Small, minimum-capability platforms have several advantages over large, full-capability platforms in the development of hydrocarbon reserves in deep water. A much lower capital cost is one of the significant advantages. However, minimizing platform capability by eliminating a resident drilling rig and other useful equipment from the design also significantly limits the ability of the platform to adapt to new reservoir and/or economic information suggesting changes in the development scenario. The Tension Leg Well Jacket (TLWJ) concept was developed to address this limitation. In the TLWJ concept, a small TLP (the TLWJ, mini-spar or other minimal structure) supports the wells for surface accessible completions, but drilling and other major well operations are performed by a semisubmersible drilling rig which docks to or is otherwise restrained adjacent the TLWJ. This method of conducting well operations is more fully discussed in U.S. Pat. No. 5,199,821, issued Apr. 6, 1993 to D. A. Huete et al for a Method for Conducting Offshore Well Operations and U.S. patent application Ser. No. 024,584, filed by A. G. C. Ekvall et al on Mar. 1, 1993, now U.S. Pat. No. 5,439,324, for a Bumper Docking Between Offshore Drilling Vessels and Compliant Platforms, the disclosures of which are hereby incorporated by reference and made a part hereof.

It is understood that the smaller the floating platform, i.e., the smaller the total hull displacement, the cheaper it is. Although the size of the floating platform is mostly determined by the topsides payload demand and the number of production wells to be supported, there is a point below which the traditional rectangular hull having four comer columns connected at the keel with four horizontal pontoons is no longer an optimal configuration. Revised configurations that support the same amount deck load with shorter deck spans have cost advantages for such minimal configurations. Single column type designs have been developed to serve this need, including monopod and mini-spars, which provide the logically smallest floating platform that is moored with one or more vertical tension members.

A difficulty with the monopod and mini-spar designs are that they tend to roll and pitch (rotate about two horizontal axes), although restrained in heave (vertical motion) by the tendons. The pitch and roll responses of a monopod are troublesome because of fatigue problems in the tendons due to bending, and because of potential interference with well risers which may be arranged outside the column.

Another benefit of the decreasing the size of the structure is that lower loads on the tendons expands the scope of suitable materials for forming the tendons. Thus, full capability platforms have used thick walled tubular goods to form the tendons. These are expensive to produce and relatively difficult to deploy.

By contrast, wire rope tendons would be desirable in this fighter service for their economy and ease of installation. However, there is another contrast between tubular goods and wire rope in tendon applications. Tubular goods have greater reliability, in large part because of inspectability in manufacture and in service. The cylindrical walls of such tubular goods may be inspected inside and out. In contrast, it is more difficult to determine whether a wire rope has suffered damage because the majority of the load-carrying portion is hidden from view.

SUMMARY OF THE INVENTION

An advantage of the present invention is that it takes advantage of the minimal hull of a monopod or mini-spar, but with improved dynamic response. The improved dynamic response reduces the fatigue effects on the tendons and protects the production risers.

In combination with this advantage, the present also effectively distributes loads across a plurality of tendons and provides for failure detection for tendons in materials and fabrication techniques that would otherwise not be subject to reliable in-service monitoring. This affords greater efficiencies expanding suitable tendon materials to include wire rope or other unconventional, non-tubular tendons that can be formed of less expensive materials and fabrication techniques with greater confidence.

Toward the fulfillment of these and other advantages, the present invention provides a tension leg tripod supporting surface facilities on a deck for conducting hydrocarbon recovery operations in deepwater applications. The tension leg tripod has an elongated, buoyant central vertical column or caisson with three outrigger pontoons. A tendon cluster array is connected to each of the outrigger pontoons on one end at a location which is spaced apart from the vertical column. The other end of the tendons in the tendon cluster arrays are anchored to the ocean floor.

A BRIEF DESCRIPTION OF THE DRAWINGS

The brief description above, as well as further features and advantages of the present invention will be more fully appreciated by reference to following detailed description of illustrative embodiments which should be read in conjunction with the accompanying drawings in which:

FIG. 1 is a side perspective view of a tension leg tripod in one embodiment of the present invention;

FIG. 2 is a cross-sectional view of the tension leg tripod of FIG. 1 taken along line 2—2 in FIG. 1;

FIG. 3 is a partially cross-sectional top elevational view of a tribrach and the tendon cluster deployed in the tension leg tripod of FIG. 1, taken along line 3—3 in FIG. 1;

FIG. 4 is side elevational view of the tribrach and tendon cluster of FIG. 3, taken along line 4—4 in FIG. 1;

FIG. 5 is a partially cross-sectioned side view of the tribrach and tendon cluster of FIG. 4;

DETAILED DESCRIPTION OF SELECTED EMBODIMENTS

Figure 6:
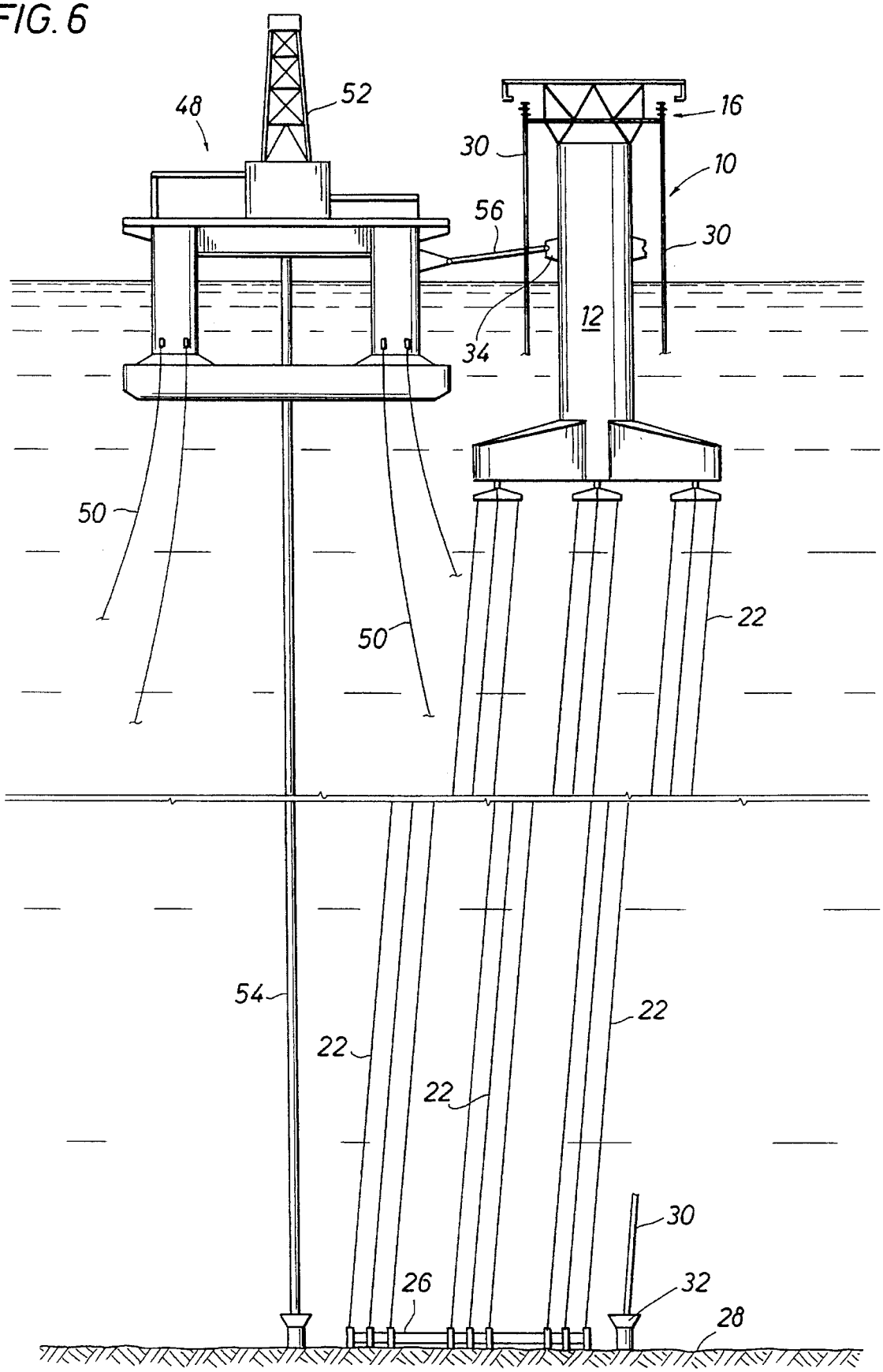
FIG. 6 is a side elevational view of a tension leg tripod accepting drilling operations from a semisubmersible drilling rig.

FIG. 1 illustrates one embodiment of a tension leg tripod 10 deploying in a body of water 20, restrained in place by tendon cluster arrays in accordance with the present invention. The tension leg tripod has an elongated buoyant central caisson or vertical column 12 supporting a deck 14 with surface facilities 16. Three outrigger pontoons 18 project radially from the base of central caisson 12 in a horizontal plane. The stability of tension leg tripod 10 may be enhanced by taking on ballast in pontoons 18.

Three tethers or tendons 22 are arranged in each of three tendon cluster array to anchor the tension leg tripod to the ocean floor (not shown) and draw it down below its free floating draft to limit heave response. Cluster arrays of tendons 22 are connected to the outrigger pontoons at substantially equal distances from central caisson 12. Tendons 22 are clustered at tribrachs 24, each connected to one of outrigger pontoons 18. The bottoms of tendons 22 are connected to foundation 26 which is secured to ocean floor 28 by conventional means such as piles. See FIG. 6.

Returning to FIG. 1, a plurality of production risers 30 connect surface facilities 16 with wells 32 on ocean floor 28 for production operations. Drilling operations may be conveniently provided on a temporary basis by a semisubmersible rig. Refer again to FIG. 6. Provisions are made to receive the drilling facilities with a plurality of semisubmersible rig docking strut receptacles 34.

FIG. 2 illustrates the arrangement in this embodiment of pontoons 18, tendons 22, tendon clusters at tribrachs 24, production risers 30, and strut docking receptacles 34 about central caisson 12. Spreading the tribachs apart on the outrigger pontoons serves to the limit roll and pitch of the tension leg caisson. Ballasting the pontoons further limits this response.

FIGS. 3, 4 and 5 illustrate tribrach 24 and clusters of tendons 22. FIG. 4 is a close up of the substantially planar, horizontally disposed tribrach 24. Tribrach 24 depends from the platform superstructure at outrigger pontoon 18 though a tendon bracket connection 36. The partially broken away view of FIG. 5 illustrates tendon bracket connection 36 in greater detail. Here, the tendon bracket connection is a hemispherical flexjoint 36A which is a steel and elastomeric laminated joint, but other connection allowing pivotal action could be used. FIG. 5 also illustrates an upper tendon connection 38 in which a termination fixture 38A is secured to tendon 22. In the illustrated embodiment, termination fixture 38A is also a hemispherical flexjoint seated in a tendon receiving receptacle 38B. See also the top view of FIG. 3.

FIG. 5 also introduces the use of installation and leveling jack 40 disposed to project from pontoon 18 through access hole 42. A jack foot 44 is presented on tribrach 24 where the jack will engage. Failure stops 44 are also illustrated in FIGS. 3 and 5. The use of these features will be discussed in greater detail in connection with FIGS. 7A–7D.

FIG. 3 illustrates an overall arrangement of failure stops 46 and jack feet 44 on lobes 58 of tribrach 24. Tendons are arranged radially and circumferentially equidistant about normal load centroid 37. Both the failure stops and the jack feet are arranged in substantially radial alignment with load lines between the normal load centroid of the tribrach and the upper tendon connections.

FIG. 6 illustrates the use of the method of conducting offshore well operations disclosed U.S. Pat. No. 5,199,821, referenced above. Semisubmersible drilling vessel 48 docks through strut 56 to tension leg tripod 10 at strut receptacle 34 on vertical column 12. Mooring lines 50 from vessel 56 are then adjusted to bring derrick 52 in line for conducing drilling operations for well 32A through a substantially vertical drilling riser 54. In this embodiment, achieving this alignment will temporarily bias tension leg tripod 10 out of its normal position centered over foundation 26. After a well is drilled, a production riser 30 is run to the well and attached to surface facilities 16 on the platform. Additional wells are drilled by repeating the process.

Figure 7A:
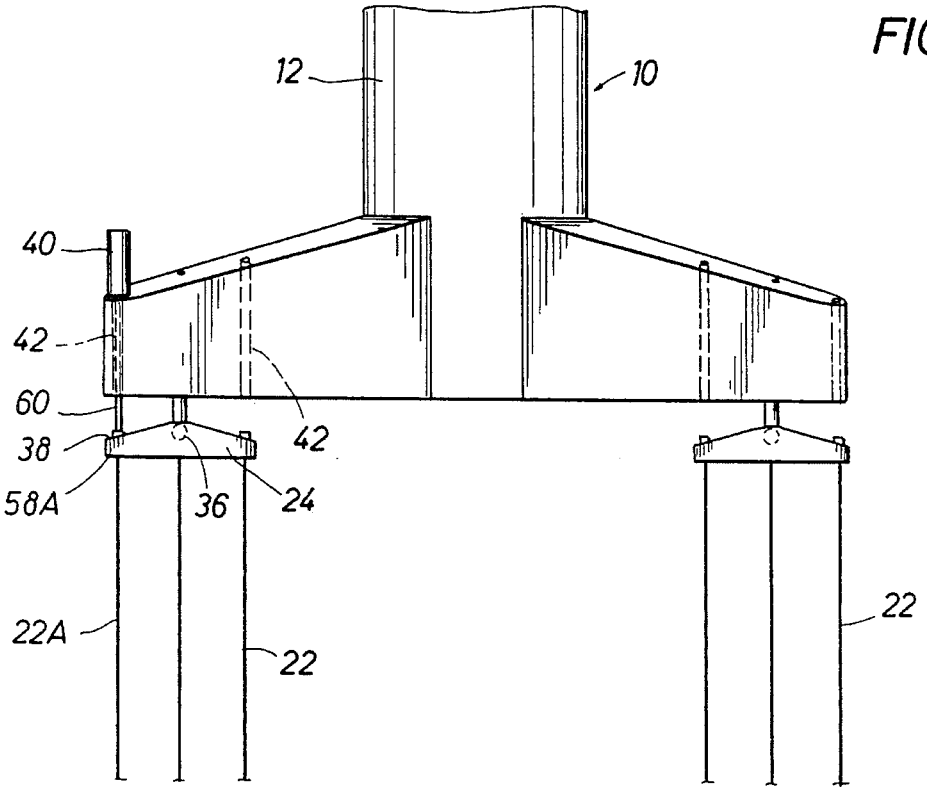
FIGS. 7A–7D illustrate tendon installation, normal deployment, failure mode and leveling compensation, respectively, in the use of tribrach and tendon clusters in a tension leg tripod.

FIGS. 7A–7D schematically illustrate the use of or tribrach 24 in clusters arrays of tendons 22 in groups of three tendons each. FIG. 7A illustrates use of jack 40 in the installation of a tendon. Jack 40 is connected to outrigger pontoon 18 and disposed to project its rod 60 through access hole 42 and against a lobe 58 of tribrach 24 at which a given tendon 22 is to be installed. Hydraulically extending rod 60 will, in a three tendon cluster, drive lobe 58A downward. This will provide greater access to upper tendon connection 38 and provide some slack facilitating secure and tight installation of termination fixture 38A within a recess 38B and about tendon 22A. See also FIG. 5.

Figure 7B:
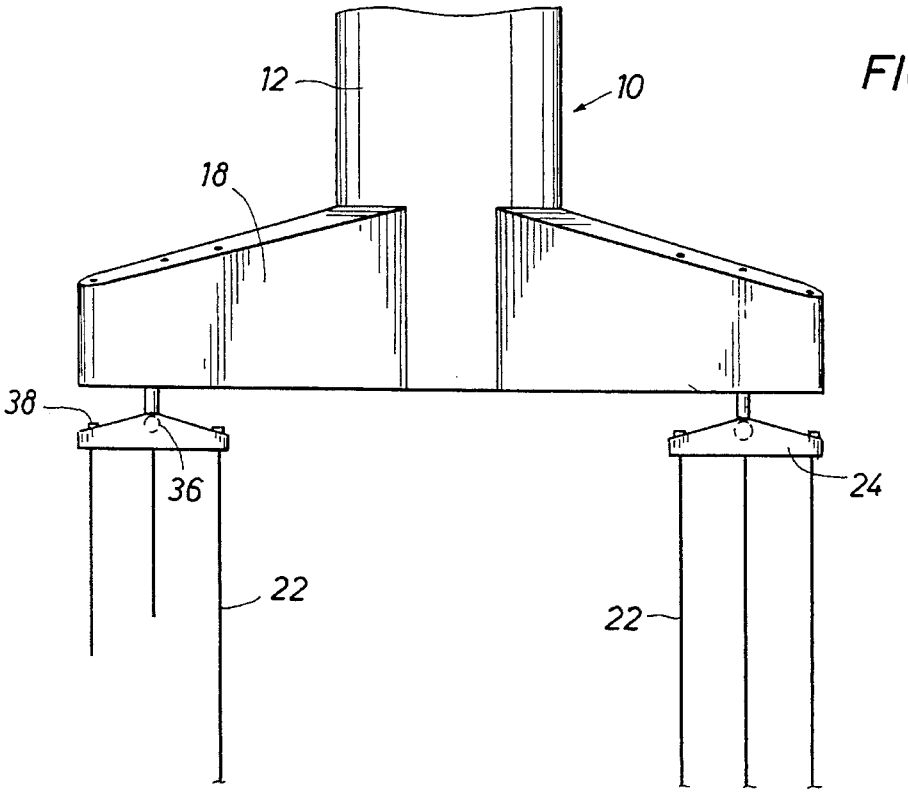
Figure 7C:
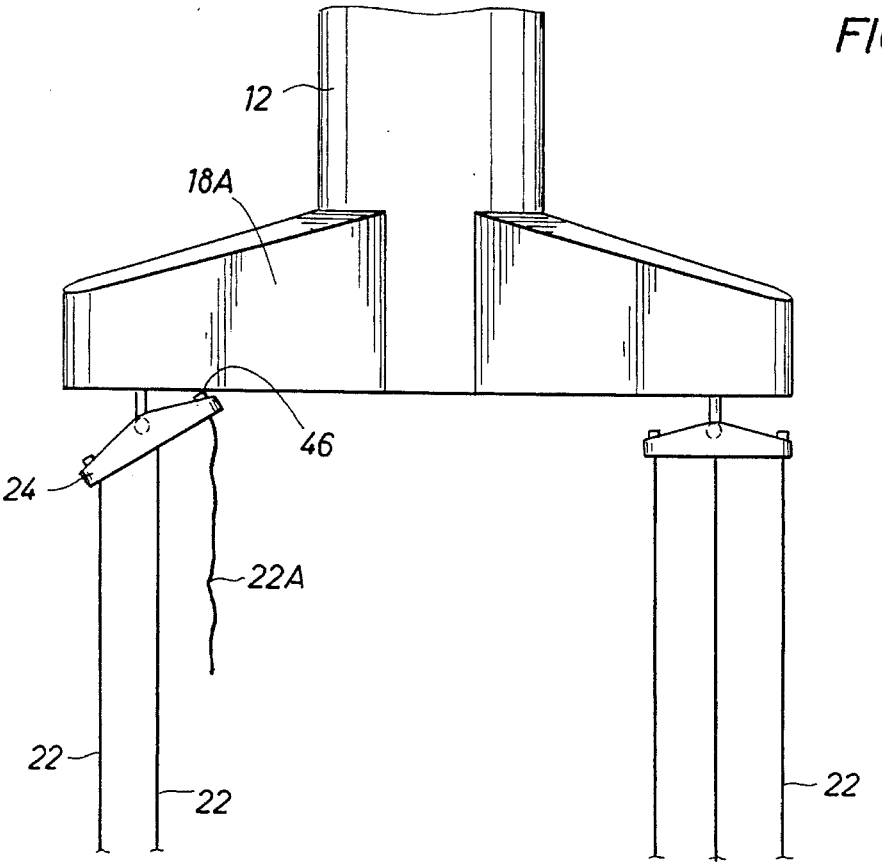
Figure 7D:
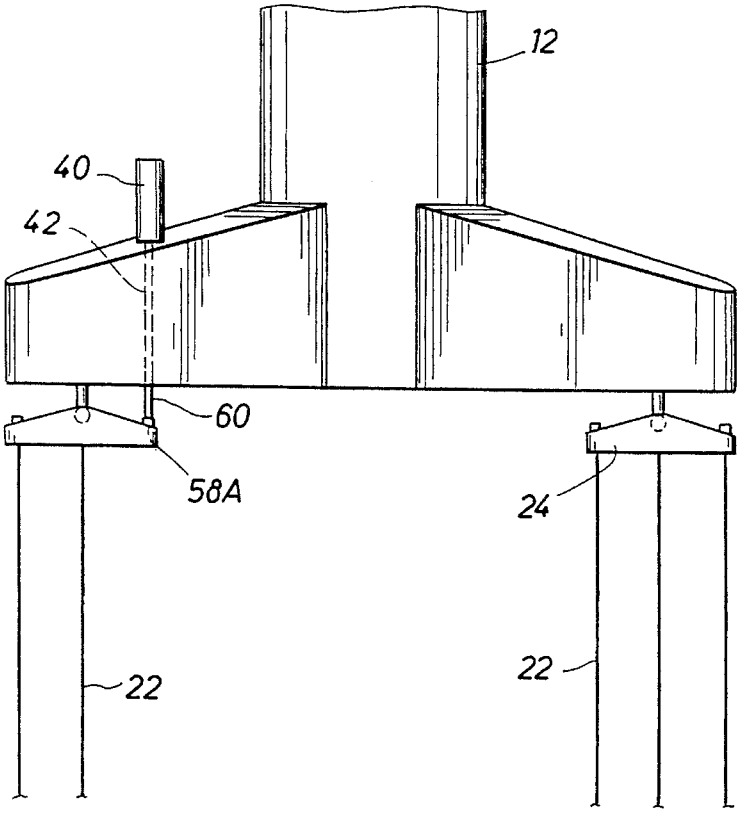

FIG. 7B illustrates the use of tendon clusters and tendon brackets at normal trim, with each of tendons 22 sharing the load in its tendon cluster. By contrast, FIG. 7C illustrates failure mode in which one of tendons 22, here tendon 22A has parted. Since one of the three determinant tendons in the tendon cluster has failed, tribrach 24 is caused to pivot about tendon bracket connection 36 until failure stop 46 is brought into contact with the bottom of outrigger pontoon 18A and the load is redistributed among the two remaining tendons.

Pivoted, the tribrach contributes to the effective length of the remaining tendons in anchoring the outrigger pontoon. This shift in one of the determinant three outrigger pontoons causes the tension leg tripod to perceptibly tilt as pontoon 18A rises. This distributes the load and provides notice that one of the tendons has failed to provide an opportunity to attend to repairs promptly. Jack 40 is also useful in leveling the platform by pushing down lobe 58A until a new tendon is available and ready for installation procedures. See FIG. 7D.

It should be appreciated that the tendon bracket/tendon cluster combination facilitates the use of wire rope or other unconventional, non-tubular tendon applications in which less expensive materials and fabrication techniques can be used in greater confidence by effectively distributing the load and having positive confirmation in the event of a partial (one tendon of cluster) failure within a redundant system.

The configuration described herein is statically determinate, in that loads in the tendons will be apportioned according to where they are connected to the caisson, and are independent of the elasticity of the tendons themselves. While remaining substantially horizontal, the tribrach will pivot to distribute this load evenly. This feature provides the benefit of simplifying tendon installation compared to conventional TLPs, as complex ballasting and tendon tensioning operations are not required.

A number of modifications, changes and substitutions are intended in the foregoing disclosure. Further, in some instances, some features of the present invention will be used without a corresponding use of other features described in these illustrative embodiments. Accordingly, it is appropriate that the appended claims be construed broadly and in a manner consistent with the spirit and scope of the invention herein.

What is claimed is:

1. A tension leg tripod for providing surface facilities for conducting hydrocarbon production operations from the ocean floor from a deepwater location, comprising:

an elongated, buoyant vertical central caisson;

a deck supported by the central caisson;

a three cornered arrangement of outrigger pontoons connected at the lower end of the central caisson in a horizontal plane; and three tendon cluster arrays, each connected on one end to one of the outrigger pontoons at a comer thereof at a position spaced substantially equidistance from the central caisson and circumferentially dispersed, the tendon cluster arrays each comprising:

three tendons anchored to the ocean floor at their lower ends;

a substantially planar substantially, horizontally disposed tribrach receiving the upper ends of the tendons; and a tendon bracket connection pivotally securing the tribrach to a downwardly disposed surface of the superstructure.

2. A tensioned leg tripod in accordance with claim 1 wherein the outrigger pontoons project radially outward from the central caisson.

3. A tension leg tripod in accordance with claim 1 wherein the outrigger pontoons are ballasted.

4. A tension leg tripod in accordance with claim 1 further comprising a plurality of semisubmersible rig docking strut receptacles connected to the center caisson to accommodate drilling operations.

5. A tension leg tripod in accordance with claim 2 wherein the tendon bracket connection is formed by a hemispherical flexjoint forming a pivotable joint at the normal load centroid of the tendon bracket.

6. A tension leg tripod in accordance with claim 5 further comprising a plurality of failure stops projecting part way between the superstructure and the tendon bracket arranged substantially in radial alignment of the upper tendon connection and the normal load centroid.

7. A tension leg tripod in accordance with claim 6, further comprising at least one jack disposable between the superstructure and the tendon bracket and arranged in radial alignment of the upper tendon connection and the normal load centroid.

8. A tension leg tripod in accordance with claim 2 wherein the tribrach further comprises:

a base having a normal load centroid and three radially disposed lobes;

a plurality of tendon receiving receptacles arranged in a horizontal plane, each presented on one of the lobes; and a tendon bracket connection suitable for pivotally securing the tribrach to a downwardly disposed surface of the tethered structure.

* * * * *